United States Patent [19]

Hodil

[11] 4,121,365

[45] Oct. 24, 1978

[54] POWER-ACTUATED TOOL LOAD MAGAZINE

[75] Inventor: Elmer Raleigh Hodil, North Branford, Conn.

[73] Assignee: Olin Corporation, New Haven, Conn.

[21] Appl. No.: 806,984

[22] Filed: Jun. 16, 1977

[51] Int. Cl.[2] ..... F42B 39/06

[52] U.S. Cl. ..... 42/88; 124/50; 221/83; 224/16

[58] Field of Search ..... 42/87, 88; 86/38, 45; 124/45, 49, 50, 53; 221/82, 83, 86; 224/15–21; 227/9–11

[56] References Cited

U.S. PATENT DOCUMENTS

| | | | |
|---|---|---|---|
| 49,523 | 8/1865 | Howlett | 224/18 |
| 1,734,852 | 11/1929 | Frampton et al. | 42/87 |
| 2,437,728 | 3/1948 | Drumheller | 124/49 |
| 2,508,820 | 5/1950 | Fraley | 42/88 |
| 2,573,003 | 10/1951 | Fraley | 42/88 |
| 3,698,115 | 10/1972 | Henning | 42/88 |
| 3,757,449 | 9/1973 | Schindler | 42/87 |
| 3,808,723 | 5/1974 | Erixon | 42/87 |
| 3,991,501 | 11/1976 | Larsson | 42/88 |

*Primary Examiner*—Charles T. Jordan

*Attorney, Agent, or Firm*—William W. Jones; Paul J. Lerner

[57] ABSTRACT

A magazine for holding a plurality of power loads for use in operating a power-actuated tool. The magazine includes a tube formed with a polygonal outer wall and is axially elongated. The inner part of the tube is formed with a plurality of separate open-ended channels in each of which a stack of power loads is disposed. Removable caps close each end of the magazine. The lower cap has a feed passage which, by rotation of the tube, can be aligned with each of the internal channels so as to allow discharge therefrom by gravity of the stack of loads disposed in the aligned channel. The feed passage can also be aligned with each of the radial webs between adjacent channels so that the magazine can be carried about free of the tool without danger that the loads can accidentally fall out of the channels. Rotation of the tube is keyed by the polygonal form of the outer wall of the tube.

19 Claims, 7 Drawing Figures

POWER-ACTUATED TOOL LOAD MAGAZINE

This invention relates to a magazine for carrying a plurality of power loads for a power-actuated tool, such as a stud fastener. More particularly, the magazine is of the gravity feed variety and includes provision for holding several stacks of power loads with the loads in each stack being disposed in end-to-end alignment.

Gravity feed magazines adapted to carry a plurality of stacks of end-to-end power loads are known in the prior art. Typical of such magazines is the construction shown in U.S. Pat. No. 3,757,449, issued Sept. 11, 1973 to W. R. Schindler. This invention is an improvement of the magazine or ammunition package shown in the 3,757,449 patent.

The magazine of this invention includes an elongated tubular main part having a plurality of internal radial spokes or ribs which divide the tube bore into a plurality of adjacent elongated cells, each of which holds a separate stack of power loads. The outer wall of the tube is polygonal, preferably pentagonal, with the radial ribs merging into the outer wall at approximately the mid point of each of the flat portions of the outer wall. The corners of the outer wall are preferably rounded. Upper and lower end caps are frictionally fitted over the ends of the tube. The lower end cap has a load feed port which can be moved into alignment with each of the cells to permit a stack of loads to drop out of the respective cells and into a loading tube on the tool. The proper alignment is achieved by rotating the tube about its axis. The lower and cap is formed with a pair of projecting lugs which engage the rounded corners of the tube so as to index the tube as it is rotated. The lugs are arranged so that at any indexed position, one lug engages the leading side of one of the tube corners and the other lug engages the trailing side of one of the other tube corners so that the tube will be detented against easy rotation in either direction. As the tube is rotated, one detented position will align the bottom of a tube cell with the discharge opening, then the next detented position will align the bottom of one of the ribs with the discharge opening, effectively closing the discharge opening against passage of a stack of loads from either of the cells having the particular aligned rib therebetween. When the tube is rotated again in the same direction, the next cell is aligned with the discharge opening and the next stack of loads is free to fall into the tool loading tube. Thus rotation of the tube results sequentially in load discharge from one cell, followed by discharge opening closure, followed by load discharge from an adjacent cell, etc. As the tube is rotated in one direction, one lug stops it at one position and the other lug prevents back up, then the other lug stops the tube at the next position while the "one" lug prevents back up, and so on.

It is, therefore, an object of this invention to provide a load magazine of the gravity loading and feeding type which includes a plurality of load stack-receiving cells angularly positioned about a common axis wherein one cell at a time is opened for gravity feeding of the stack therefrom.

It is a further object of this invention to provide a magazine of the character described wherein the cells are contained in a tubular member having a polygonally configured side wall when viewed along the axis of the tube.

It is yet another object of this invention to provide a magazine of the character described wherein the magazine is emptied by rotating the tubular member about its axis, and wherein positioning of the tubular member is controlled by detents acting upon the polygonal side wall of the tubular member.

It is an additional object of this invention to provide a magazine of the character described wherein the cells are shaped so as to be able to contain different diameter power loads and feed them equally well.

These and other objects and advantages of the invention will become more readily apparent from the following description of a preferred embodiment of the invention taken in conjunction with the accompanying drawings, in which.

Figure 1:
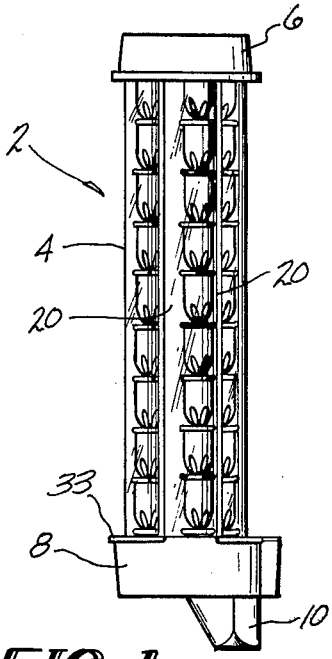
FIG. 1 is a side elevational view of a preferred embodiment of the magazine of this invention.

Referring now to FIG. 1, the magazine 2 shown includes a tube part 4 which is open on both ends. An upper closure cap 6 is frictionally fitted onto the upper end of the tube 4 to close the upper end thereof, and a lower closure cap 8 is frictionally fitted onto the lower end of the tube 4 to close the lower end thereof. The lower closure cap 8 includes a boss 10 depending downwardly from the lower surface thereof. FIG. 1 shows the several stacks of power loads in the form of cased rim fire blanks disposed in the tube.

Figure 2:
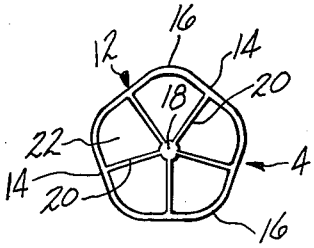
FIG. 2 is an end view of the tube part of the magazine of FIG. 1 showing the configuration of the cells which receive the stacks of power loads.

Looking at FIG. 2 it will be noted that the outer wall 12 of the tube 4 is polygonal in configuration, the preferred shape shown being a pentagon. The side wall 12 has a plurality of relatively straight segments 14 joined together by radiused corners 16. Centrally of the tube 4 there is a hub 18 from which radiate a plurality of spokes 20. Each spoke 20 merges into one of the straight side wall portions 14 at approximately the mid-point thereof. The spokes 20 extend for the full axial extent of the tube so as to form a plurality of cells 22 in which the stacks of loads are positioned. The cross-sectional configuration of each cell is fan or pie slice-shaped rather than circular. This configuration permits the cells to receive more than one diameter load, thus the magazine can be used to hold high power loads of larger caliber or diameter, or lower power loads of smaller caliber or diameter. The shape of the tube also lends itself readily to formation from a resinous material by extrusion or injection molding.

Figure 3:
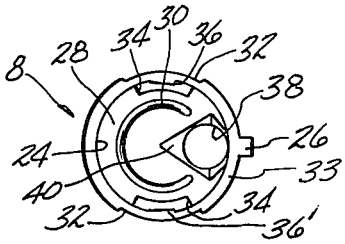
FIG. 3 is a top plan view of the bottom closure cap of the magazine of FIG. 1 showing its internal structure.

Referring now to FIG. 3, details of the construction of the bottom closure cap 8 are shown. The cap 8 includes an upstanding annular side wall 24 which receives the lower end of the tube 4. A radially outwardly projecting key lug 26 is formed on the outside of the substantially circular cap 8. The bottom wall 28 of the cap 8 is formed with a C-shaped upstanding ridge 30 on which the bottom surface of the tube 4 rests so as to reduce friction when the tube 4 is rotated. The side wall 24 is thinned out at diametrically opposed locations 32, preferably by forming interruptions in annular stiffening flange 33, and correspondingly located slots 34 are formed in the bottom wall 28. Inwardly projecting detent lugs 36 and 36' are formed on the inner surface of the side wall 24 at the thinned locations 32. The detent lugs 36 and 36' are made radially resilient by reason of the thinned parts 32 of the side wall and the slots 34 and include ramp surfaces **36*a*, 36*a'*, inclined relative to radii of the bottom wall 28, which direct the lugs 36, 36' radially in a manner which will hereinafter be made apparent. A vertical discharge opening or port 38 extends through the boss 10 (see FIG. 1) for discharging a stack of loads from the tube 4. The cap bottom wall 28 is undercut at 40 to form a funnel leading to the discharge opening 38 to facilitate smooth feeding of a load stack from the tube 4 through the opening 38**.

Figure 4:
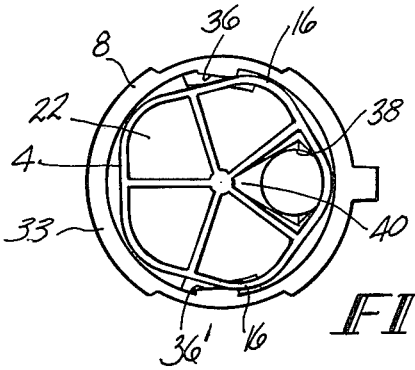
FIG. 4 is an enlarged end view of the tube set into the bottom closure cap showing the interaction between the two parts, and showing the tube indexed to a feeding position.
Figure 5:
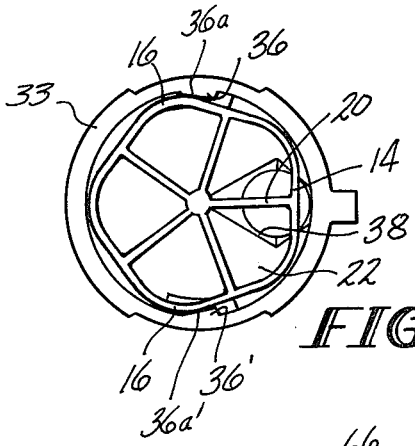
FIG. 5 is a view similar to FIG. 4 but showing the tube indexed to a closed position wherein loads cannot pass through the feed port.

Referring now to FIGS. 4 and 5, the manner in which the tube 4 is received in the lower end cap 8 and indexed therein is shown. Assume that the tube 4 has been rotated about its longitudinal axis in a counter-clockwise direction to bring it to the position relative to the cap 8, the latter of which is held fixed in the tool, which position is shown in FIG. 4. Looking at FIG. 4 it will be appreciated that the position shown therein is a load feeding position since one of the cells 22 is directly over and aligned with the discharge opening 38. Thus the stack of loads in that cell will fall by gravity out of the cell and through the discharge opening 38. It will also be appreciated that the respective shapes of the cell and funnel 40 are similar so as to promote proper feeding of the load stack and minimize the chance of individual loads in the stack turning out of proper alignment as they pass from the cell through the opening 38. It will be appreciated that the tube 4 will be indexed to the position shown in FIG. 4 by reason of the detent 36 engaging the leading side of one of the rounded corners 16 on the tube 4 as the latter is rotated in the counter-clockwise direction about its axis. Furthermore, the tube 4 is also held against reverse rotation (in the clockwise direction) by reason of the other detent 36' engaging the trailing side of another of the rounded corners 16 on the tube.

After a stack of loads is dropped out of a cell the tube 4 will be rotated again in the counter-clockwise direction and the next indexed position it will assume is shown in FIG. 5. In the position shown in FIG. 5, one of the spokes 20 and one of the straight side portions 14 overlies the discharge opening 38 to effectively close off the latter against passage of a stack of loads from any of the cells 22. In this position the magazine may be removed from the tool, handled and carried about without danger of the load stacks falling out of their respective cells. It will be noted that the tube 4 is indexed to the position shown in FIG. 5 by reason of the detent 36' engaging the leading side of one of the rounded corners 16 on the tube. Again, the tube 4 will be held against reverse rotation by the other detent 36 engaging the trailing side of another of the rounder corners 16 on the tube. To drop the next stack of loads from the magazine, rotation of the tube 4 is continued in a counter-clockwise direction past the sensed position shown in FIG. 5 to the next indexed and sensed position which is again as shown in FIG. 4, at which time the next cell 22 will be disposed over the discharge opening 38 and at which time the stack of loads therein will drop out of the tube through the discharge opening 38. Thus for successive discharges of two stacks of loads, the operator twists or rotates the tube 4 from one discharge position past an intermediate sensed indexed position to the next sensed indexed position which corresponds to the next load discharging position. It will be recognized that the intermediate sensed indexed position corresponds to that shown in FIG. 5.

Figure 6:
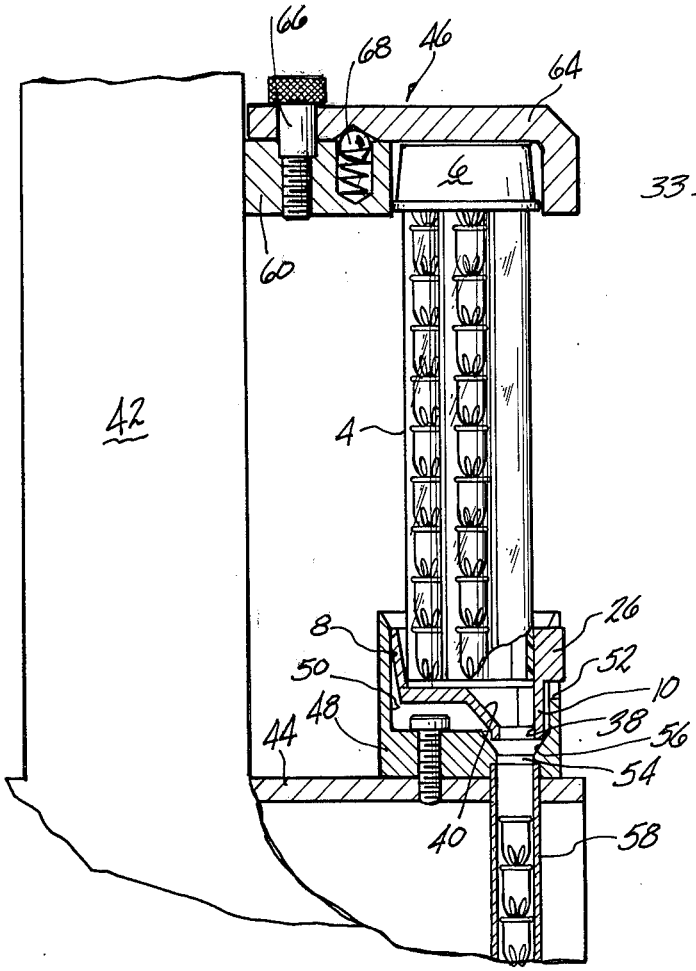
FIG. 6 is a fragmented side elevational view, partially in section, of a tool showing the magazine of this invention mounted in place thereon.
Figure 7:
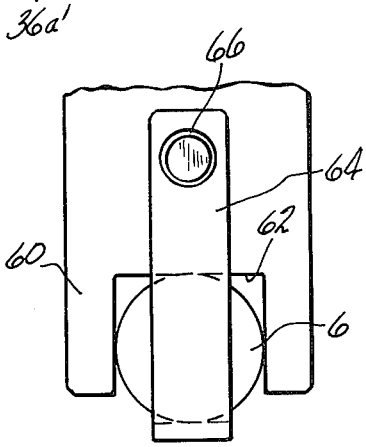
FIG. 7 is a top view of the holder portion of the tool of FIG. 6 showing how the magazine is set in and released from the tool.

Referring now to FIG. 6, the magazine assembly described above is shown mounted in a tool of the type disclosed in my copending application Ser. No. 760,059, filed Jan. 17, 1977. Only the appropriate portion of the tool is illustrated to demonstrate how the magazine is used with the power-actuated tool. The tool includes a trigger rod tube 42 to which are secured a housing 44 and an upper retaining assembly 46. Secured to the housing 44 is a block 48 which includes an internal recess 50 into which the lower closure cap 8 of the magazine is telescoped. The magazine cap key lug 26 slides into a slot 52 formed in the block 48 to hold the cap 8 against rotation within the recess 50. A through bore 54 is formed in the block 48 in alignment with the magazine discharge opening 38. FIG. 6 shows the nature of the funnel 40. The bore 54 is formed with a lead chamfer 56 into which the magazine boss 10 extends. Below the block bore 54 and in alignment therewith is disposed a load-holding tube 58 into which a stack of loads is dropped preparatory to being chambered one at a time in the tool. The tube 4 is shown in FIG. 6 indexed to a load feeding position, such as is shown in FIG. 4, with one of the cells being empty and its previously held load stack being shown disposed in the load-holding tube 58 of the tool. The upper retaining assembly 46 includes a fork-shaped holder part 60 secured to the trigger tube 42, with the upper closure cap 6 of the magazine being nested in the fork recess 62. A clamp 64 is mounted on the holder part 60 and pivots thereon about a lock bolt 66. A ball detent 68 locates the clamp 64 in a holding position wherein the clamp 64 overlies the top of the upper closure cap 6 of the magazine to hold the latter in place on the tool.

It will be readily apparent that the magazine can be filled by removing either upper closure cap 6 or lower discharge cap 8, dropping a stack of loads into each cell and replacing the cap 6 or 8 in the position shown in FIG. 5. At the proper time, the filled magazine can be mounted on the tool and the tube rotated one segment to drop a stack of loads into the feed tube of the tool. It will be appreciated that the tube can be rotated in either the clockwise or counterclockwise direction and the magazine will operate properly either way. It should also be noted that the magazine of this invention can be used with other types of tools which can be loaded using a gravity feed principle. For example, the magazine of this invention could be used with the type of tool disclosed in U.S. Patent application Ser. No. 745,747 filed Nov. 29, 1976.

Since many changes and variations of the disclosed embodiment of the invention may be made without departing from the inventive concept, it is not intended to limit the invention otherwise than as required by the appended claims.

What is claimed is:

1. In a dispensing device of the type having a plurality of cylindrical storage cells at least partially closed at one end by end closing means and adapted to receive a multiplicity of items for storage therein, and wherein said storage cells are emptied sequentially with the contents of each cell passing serially through a dispensing port in a closure member at a second end of said cells, said closure member being adapted for alternately indexing between one of a first series of positions whereat said port is aligned with one of said cells and one of a second series of positions whereat all of said cells are closed by said closure member; the improvement comprising: improved means for indexing of said closure member including abutment means on an exterior surface of each of said cells and releasable means integrally formed on said closure member, for engagement with said abutment means, said storage cells being defined by a thin-walled tubular member of polygonal cross-section, a central hut extending axially of said tubular member, and a plurality of planar spokes joining said hub and said tubular member, said tubular member comprising a plurality of substantially planar segments merging in radiused corners, and said spokes each joining said tubular member proximate the midpoint of each of said segments, whereby each of said cells includes one of said corners, said corners forming said abutment means.

2. The dispensing device of claim 1, wherein said closure member comprises a substantially circular transverse bottom wall and an upstanding annular side wall; and said abutment-engagement means comprises at least two lugs located on the inner surface of said side wall and disposed in circumferentially spaced relation such that, upon rotation of said closure member relative to said tubular member, at least one of said lugs engages a leading side of one of said corners while simultaneously another of said lugs engages a trailing side of one of said corners, whereby further rotation in either direction is resisted, allowing said rotation to be performed in a controlled, discreet, step-wise manner.

3. The dispensing device of claim 2, wherein at least two of said lugs are disposed in substantially diametrically opposed relation on said closure member.

4. The dispensing device of claim 2 further comprising flexure-enhancing means on said closure member of facilitating radial displacement of said lugs.

5. The dispensing device of claim 4, wherein said flexure-enhancing means comprises reduced gauge portions of said sidewall, said portions including said lugs.

6. The dispensing device of claim 4, wherein said flexure-enhancing means comprises slots formed in said bottom wall proximate said lugs.

7. The dispensing device of claim 4, further comprising means on said closure member for reducing the area of contact between the same and said tubular member to minimize frictional forces produced during relative rotation thereof.

8. The dispensing device of claim 7, wherein said contact-reducing means comprises a substantially C-shaped, upstanding ridge disposed on an inner surface of said bottom wall, whereby said tubular member rests on said ridge.

9. The dispensing device of claim 1 wherein said end closing means comprises a removable cap member, whereby simultaneous access is provided to all of said cells.

10. The dispensing device of claim 1, wherein said port comprises a funnel disposed on an outer surface of said bottom wall opening toward said tubular member and communicating with the interior thereof, whereby items being dispensed from said device are urged into a uniform end-to-end orientation.

11. The dispensing device of claim 1, wherein said polygonal cross-section is a pentagon.

12. In combination with a power actuated tool, a magazine comprising a tubular body subdivided into a plurality of cylindrical storage cells each adapted to receive a multiplicity of power loads; a bottom closure; and a top closure; said bottom closure including a dispensing port and being rotatable relative to said body and cooperative therewith, whereby said cells may be emptied sequentially with the contents of each cell passing serially through said port, means coactive between said body and said bottom closure for alternately indexing the same between one of a first series of positions whereat said port is aligned with one of said cells and one of a second series of positions whereat all of said cells are closed by said bottom closure, said magazine being adapted for attachment to said tool by means on said tool receiving said end closures, said bottom closure having means for interlocking engagement with said tool, whereby said magazine may be indexed by rotation of said body relative to said tool.

13. The magazine of claim 12, wherein said means for interlocking engagement comprises at least one projecting lug adapted for mating with a recess in said means of said tool receiving said end closures.

14. The magazine of claim 13, wherein said port includes a funnel opening toward said tubular body and communicating with the interior thereof whereby power loads exiting the same are urged into a uniform end-to-end orientation.

15. A one-piece end closure for use on a power load magazine for a power-actuated tool, said end closure being formed of a resilient material and comprising a substantially planar transverse bottom wall, an upstanding annular side wall, a dispensing port, and self-biasing lug means for cooperation with the magazine to permit indexing of said port between a finite number of predetermined positions, said dispensing port comprising a funnel disposed on said bottom wall and providing passage therethrough, said funnel opening toward said bottom wall, whereby power loads passing therethrough are urged into an end-to-end orientation.

16. The end closure of claim 15, wherein said side wall includes a projecting lug adapted for interengagement with the tool, whereby relative rotation between the end closure and the tool is prevented.

17. A one-piece end closure for use on a power load magazine for a power-actuated tool, said end closure being formed of a resilient material and comprising a substantially planar transverse bottom wall, an upstanding annular side wall, a dispensing port, and self-biasing lug means for cooperation with the magazine to permit indexing of said port between a finite number of predetermined positions, said lug means comprising a plurality of lugs disposed on an inner surface of said side wall and flexure-enhancing means on said side wall and said bottom wall for facilitating the radial displacement of said lugs.

18. The end closure of claim 17, wherein said flexure-enhancing means comprising reduced gauge portions of said side wall adjacent said lugs and slots formed in said bottom wall proximate said lugs.

19. The end closure of claim 17, wherein said lugs include ramp surfaces inclined relative to radii of said bottom wall.

* * * * *

UNITED STATES PATENT AND TRADEMARK OFFICE

CERTIFICATE OF CORRECTION

PATENT NO. : 4,121,365

DATED : October 24, 1978

INVENTOR(S) : Elmer R. Hodil

It is certified that error appears in the above—identified patent and that said Letters Patent is hereby corrected as shown below:

Column 1, line 32, "and" should read -- end --.

Column 5, line 17, "hut" should read -- hub --.

Column 5, line 43, "of" should read -- for --.

Signed and Sealed this

Sixth Day of July 1982

[SEAL]

Attest:

GERALD J. MOSSINGHOFF

Attesting Officer

Commissioner of Patents and Trademarks